United States Patent [19]

Smith

[11] 4,375,704

[45] Mar. 8, 1983

[54] UNITARY ASSEMBLY FOR ATTACHMENT TO A TOILET FOR VENTILATING THE SAME

[76] Inventor: Donald L. Smith, 452 Nassau, Bolingbrook, Ill. 60439

[21] Appl. No.: 372,544

[22] Filed: Apr. 28, 1982

Related U.S. Application Data

[63] Continuation of Ser. No. 124,221, Feb. 25, 1980, abandoned.

[51] Int. Cl.[3] ..... E03D 9/04; A47K 13/00

[52] U.S. Cl. ..... 4/213; 4/216

[58] Field of Search ..... 4/209 R, 216, 217, 213

[56] References Cited

U.S. PATENT DOCUMENTS

| | | | |
|---|---|---|---|
| 3,469,267 | 9/1969 | Kuklok | 4/213 |
| 3,534,415 | 10/1970 | Huffman | 4/213 |
| 3,857,119 | 12/1974 | Hunnicutt, Jr. | 4/213 |
| 4,094,023 | 6/1978 | Smith | 4/213 |
| 4,168,553 | 9/1979 | Studer | 4/213 X |

*Primary Examiner*—Henry K. Artis

*Attorney, Agent, or Firm*—Mawhinney, Mawhinney & Connors

[57] ABSTRACT

A unitary assembly is adapted to be attached to a toilet for ventilating odors from the bowl and has an air scoop positionable between the bowl and the seat at the rear of the bowl in communication with the bowl with such air scoop being mounted on the bowl by bracket means attached to the conventional bolts that hingedly attach the seat to the bowl. Such air scoop has a laterally offset communicating duct that supports at its outer end and communicates with a power driven suction blower unit positioned to one side and behind the bowl with a flexible exhaust tube connected to the outlet of such blower unit and positioned vertically within the bowl and provided with a free terminal outlet portion disposed within the normal pool of water in the bowl and positioned behind the trap in the bowl and having opening means disposed in arrangement with the pool of water so as to form a trap in the exhaust tube.

2 Claims, 5 Drawing Figures

UNITARY ASSEMBLY FOR ATTACHMENT TO A TOILET FOR VENTILATING THE SAME

This is a continuation of application Ser. No. 124,221 filed Feb. 25, 1980, now abandoned.

BACKGROUND OF THE INVENTION (1) Field of the Invention

The present invention generally appertains to novel improvements in toilet constructions and specifically relates to a new and novel unitary ventilating assembly for attachment to toilets to function to eliminate offensive odors associated with the normal usage of toilets. In particular, the present invention constitutes new and novel improvements over my prior U.S. Pat. No. 4,094,023 granted June 13, 1978.

(2) Description of the Prior Art

In U.S. Pat. No. 4,094,023, there is disclosed a ventilating arrangement for a toilet which includes an electrically powered suction blower unit mounted on and over the entire rear lip of the toilet bowl as a partof the toilet bowl construction and which is composed of many components and is mounted and positioned in a very conspicuous manner. The ventilating arrangement is more or less permanently attached to a toilet which has a bowl provided with a base formed internally with a discharge passage to be connected to a piping in communication with a sewer line and provided with a trap above such passage with a normal pool of water being in the bowl above the trap so as to provide a water seal to prevent any gases from entering into the bowl from the sewer line. The ventilating arrangement for removing odors from the pool includes an intake suction line communicated with the interior of the bowl when the seat is rested on the rim portion. In particular, such suction line is cemented on the underside of the seat and rests on the rim of the bowl. Such suction line extends around between the bowl rim and the seat and has apertures in communication with the interior of the bowl. A power driven suction blower unit is mounted on the rear lip or flange portion of the bowl where the seat is attached to the bowl and has an inlet connected to the suction line. An exhaust tube is connected to the outlet of the suction blower unit and has a portion positioned vertically within the bowl with the vertical portion having an elbow positioned within the bowl trap and provided with a free terminal outlet portion positioned behind the trap and having opening means dispose in arrangement with the pool of water so as to form a trap in the exhaust tube whereby odors from the bowl are conveyed directly to the discharge passage of the bowl for passage to the sewer line while the normal water pool in the bowl provides a water seal to prevent any sewer gases from entering the exhaust tube through the elbow.

The apertured intake suction line on the bottom of the seat has an extension that projects outwardly and rearwardly from the seat and terminates in a free end with a disc-like fitting that, when the seat is lowered to rest on the rim of the bowl, facially mates with a similar disc-like fitting provided on the free end of an inlet tube for the suction blower unit.

Such arrangement is highly satisfactory but involves a number of components and is more or less permanently attached to a toilet. In addition, the mating fittings are exposed at one side of the toilet and are unsightly and tend, through usage, not to always mate properly.

SUMMARY OF THE INVENTION

It is a primary object of the present invention to provide a unitary assembly that can be sold in kit form and assembled by an unskilled householder on a toilet bowl using the normal structure and assembly of the toilet.

Another important object of the present invention is to provide a simple, very compact and inexpensive ventilating unitary assembly that is mounted on the conventional bolts that hingedly attach the toilet seat to the bowl. The air scoop has an offset air duct at its rear end with the duct preferably extending laterally of the bowl and being disposed in a horizontal plane. The air scoop is in constant air flow communication with the duct which has an open end that is connected to and carries a depending power driven suction blower unit. The power driven suction blower unit includes a blower motor with a squirrel cage impeller on top thereof and with an air space between the motor and the squirrel cage impeller which has a laterally extending discharge section to which one end of a flexible exhaust tube is connected. The tube extends down into the bowl at the rear thereof and has a vertical portion within the bowl having an elbow positioned within the bowl trap and provided with a free terminal outlet portion positioned behind the trap and having opening means disposed in arrangement with the pool of water so as to form a trap in the exhaust tube whereby odors from the bowl are conveyed directly from the discharge passage of the bowl for passage to the sewer line while the normal water pool in the bowl provides a water seal to prevent any sewer gases from entering the exhaust tube through the outlet.

Thus, it can be appreciated that the unitary ventilating assembly is attached to and supported by the bolts which are conventionally employed to mount the seat on the bowl with the same being of an overall compact assembly of few parts. The unitary ventilating assembly is intended to be purchased in a package from a hardware or the like store and attached to the toilet by anyone, without any plumbing skill. It is only necessary in installing the assembly to remove the nuts on the seat bolts and insert the bracket means in position so that the same is mounted on the seat bolts and held on the bolts by the usual nuts. The exhaust tube is of a configuration to be easily positioned within the bowl so that its free terminal outlet portion is positioned behind the trap. In one form of the invention, such exhaust tube has a flattened side so that it can be cemented to the inner and outer walls of the trap. The flat side of the exhaust tube and one side of the seal will have paper covered adhesive thereon so that the paper can be stripped off and the tube and seal pressed in place. Both the seal and the exhaust tube will come in a length that will permit them to be cut so as to conform to different seats and traps.

DESCRIPTION OF THE PREFERRED EMBODIMENTS

Figure 1:
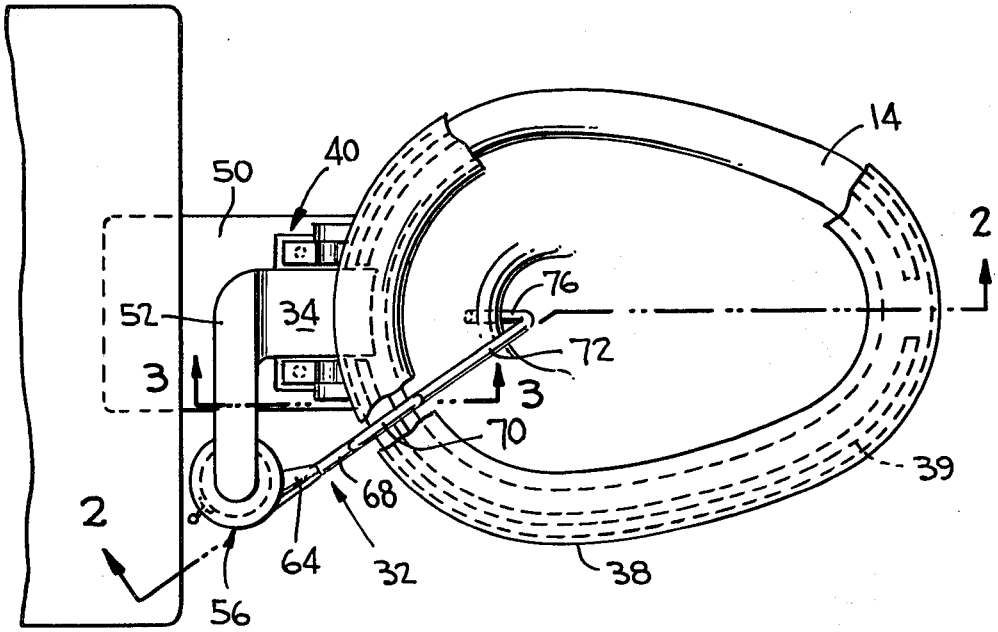
FIG. 1 is a top plan view of a toilet assembly showing the unitary ventilating assembly of the present invention installed on a conventional toilet.

Referring now more particularly to the accompanying drawings, the toilet bowl 10 has a rim 12 which is provided with a flat upper face 14. The bowl, in conventional fashion, has a bottom 16 which is provided with a discharge passage 18 that is connected to a piping for communication with a sewer line. A trap 20 is provided above the passage and has an upper wall 22 provided with an upper face 24 and a lower face 26, the trap also including a lower wall 28. Reference numeral 30 designates a normal pool of water that is in the bowl above the trap 20 to prevent any gases from entering into the bowl from the sewer line through the discharge passage 18.

The unitary ventilating assembly 32 of the present invention includes an air scoop 34 that can be molded from plastics or the like material and which has an open concave outer end 36 that is positioned so as to be in communication with the bowl with the air scoop 34 being disposed between the underside of the seat 38 and the rim face 14. A flexible sealing strip 39 is cemented on the underside of the seat so as to serve as a seal between the seat and the bowl when the seat rests on the rim of the bowl whereby gases from the bowl are only free to enter into the air scoop 34 through the open end 36 which is concaved to conform with the curvature of the rear end of the bowl and seat. The sealing strip 39 is formed from flexible material such as rubber or plastic and, preferably, has a pressure sensitive adhesive face which is covered with a paper strip. Thus, in installing the sealing strip, the same is cut to the proper length to conform to the extend of the underside of the seat and then the paper is peeled off and the adhesive face of the sealing strip is placed on the underside of the seat and the strip is pressed onto the seat.

The unitary ventilating assembly 32 is of a simple construction with the entire assembly or unit being supported on the bowl by bracket means 40. The bracket means 40, as shown particularly in FIGS. 1 and 4, includes ears 41 and 43 which project laterally from the sides 44 of the air scoop and which are provided with vertical apertures 46. The ears are adapted to rest on the bowl and the apertures are provided to receive the usual toilet seat bolts 48. Such bolts 48 are of conventional construction and are normally provided and utilized to hingedly attach the seat to the rearwardly extending flange or rear lip 50 of the bowl 10.

The air scoop 34 terminates in a duct 52 which is laterally offset from the rear end of the scoop and is in communication therewith. Ideally, the scoop and the offset duct portion 52 are formed integrally from suitable plastics or other sturdy but inexpensive materials. The duct 52, which appears as a lateral arm of the air scoop, is disposed rearwardly of the seat and is offset laterally from the rear lip 50 of the bowl and is practically hidden thereby, as can be appreciated from FIGS. 2 and 3. The duct terminates in a downturned outer end 54 which communicates with and supports a power driven suction blower unit 56. The unit 56 includes a squirrel cage impeller 58 supporting on its underside an electric motor 60 with the motor being vertically spaced from the housing for the blower unit 58 so that it is isolated from the gases. The motor is provided with an electrical cord 61 that has a plug on its outer end which can be plugged in to any suitable convenience outlet and it has a switch 62 for rendering it operative and inoperative.

The housing for the blower unit is provided with an integral tapered outlet 64 terminating in a mouth 66 to which the inner end of a flexible exhaust tube 68 is sealingly attached by a suitable means such as adhesive or the like. The exhaust tube will be supplied in a given length to go with any bowl and it can be cut to the desired size for use with a particular bowl. It is flexible, being formed from plastic or rubber, and can be bent into the desired shape. It has a portion 70 that is adapted to lie across the upper face 14 of the rim of the bowl and is positioned between the seat and the bowl and is prevented from being squeezed by the seal 40. The exhaust tube has a vertical portion 72 that is positioned vertically within the bowl, as can be appreciated from FIG. 2. The vertical portion has an elbow 74 positioned within the bowl trap and provided with a free terminal outlet portion 72 positioned behind the wall 22 of the trap and having opening means 78 disposed in arrangement with the pool of water 30 so as to form a trap in the exhaust tube whereby odors from the bowl are conveyed directly to the discharge passage of the bowl for passage to the sewer line while the normal water pool 30 in the bowl provides a water seal to prevent any sewer gases from entering the exhaust tube through the elbow portion thereof.

Figure 2:
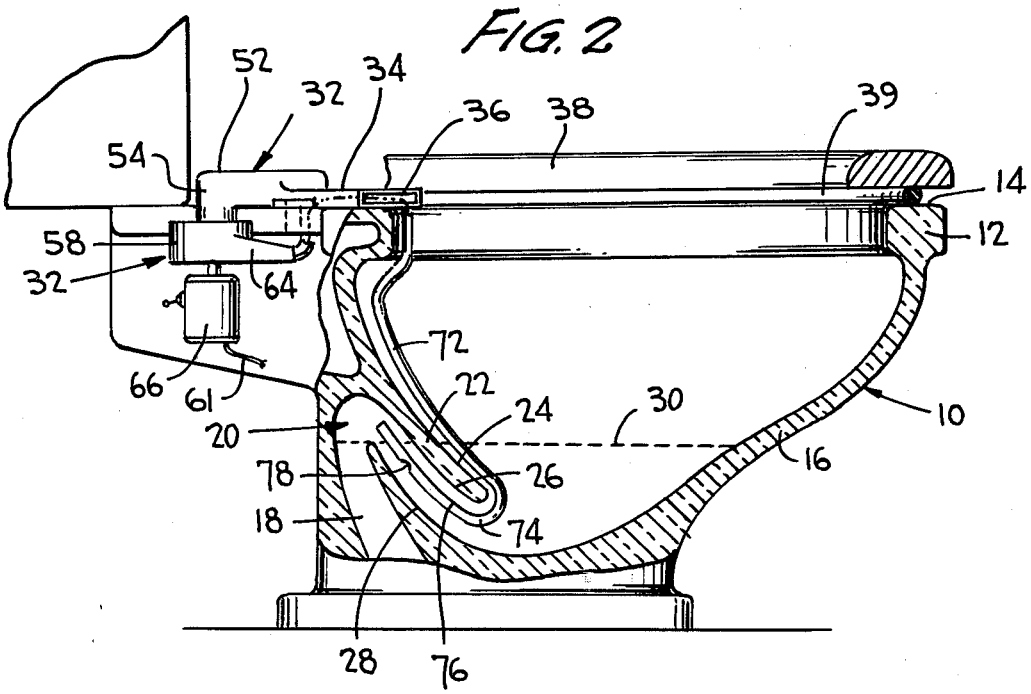
FIG. 2 is a longitudinal vertical sectional view, taken substantially on line 2—2 of FIG. 1.
Figure 3:
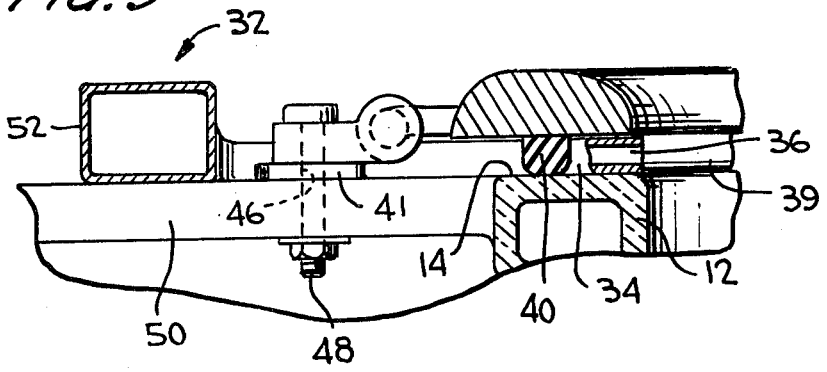
FIG. 3 is a vertical sectional view taken substantially on line 3—3 of FIG. 1.
Figure 4:
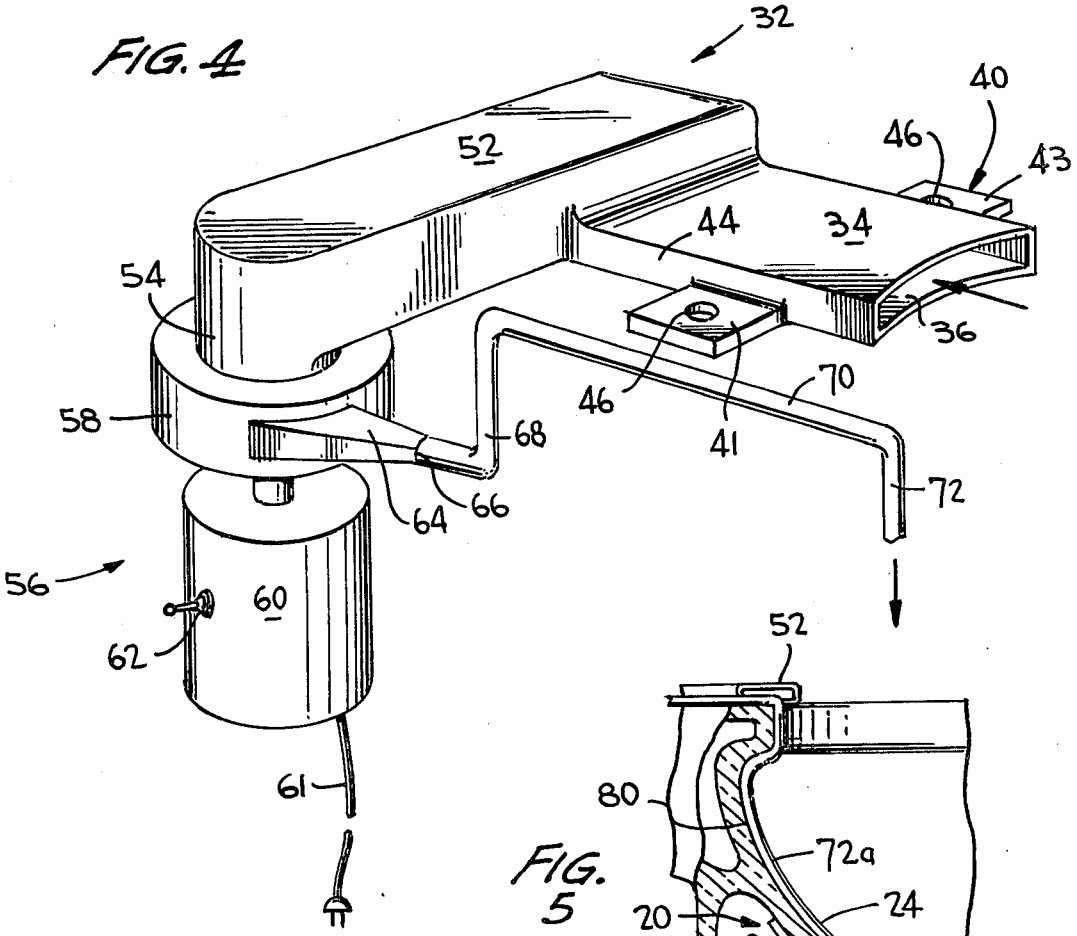
FIG. 4 is a perspective view of the unitary ventilating assembly per se.

It can be appreciated, especially considering FIGS. 2 and 4, that the unitary ventilating arrangement 32 can be purchased in a package as a kit assembly and that the air scoop 34 with its offset duct 52 and the power driven suction blower unit 56 are unitarily assembled together. The exhaust tube 70 can be cut to size and one end connected to the mouth 66 of the outlet 64 of the suction housing by suitable means, such as adhesive. Therefore, all that is necessary is for the purchaser to remove the bolts 48 and then reinsert the bolts in their normal positions with the shanks of the bolts passing through the apertures 46 in the ears 41 and 43 of the bracket means 40. The entire unit 32 is then installed and it is only necessary to locate the exhaust tube 68 in its proper position, having regard to the portion positioned within the bowl trap. The entire assembly can be accomplished in a matter of several minutes by a person without any mechanical skill.

Figure 5:
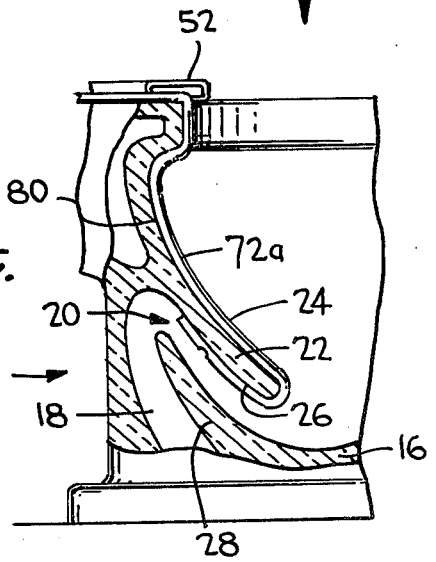
FIG. 5 is a side elevational view of a modified form of exhaust tube.

As shown in FIG. 5, the exhaust tube **72*a* can be formed with a flat side or face 80 which is covered with pressure sensitive adhesive. Such adhesive face 80 is covered with a protective paper cover (not shown) that is removed after the exhaust tube is cut to size. The flat face is then pressed against the walls of the trap as shown in FIG. 5** so that the exhaust tube is firmly affixed in place.

While the best known forms of the present invention have been disclosed herein, it is to be understood that such is merely exemplary of the concept of the invention and that the same is only limited by the scope and spirit of the appended claims.

What is claimed is:

1. For use with a toilet having a bowl provided with a base formed internally with a discharge passage to be connected to a piping for communication with a sewer line and provided with a trap above said passage and with an upper rim on which a seat is adapted to rest with the seat being hinged to the bowl by hinge means between the rear lip of the bowl rim and the seat and with a normal pool of water being in the bowl above the trap so as to provide a water seal to prevent any gases from entering into the bowl from the sewer line; a unitary venting assembly comprising a hollow air scoop having a flat bottom wall adapted to sit on the rear lip of the bowl between the hinge means, means for mounting said scoop on the rear lip with said bottom wall being sealingly engaged with the surface of the rear lip, said air scoop having an arcuate open front end that conforms with the curvature of the rear of the bowl and communicates with the interior of the bowl so that gases from the bowl flow into the open end of the air scoop which has a closed rear end portion, a hollow duct extending laterally from the rear end portion and through which the bowl gases flow, said duct having an integral outer terminal end portion extending downwardly, a power driven suction blower unit supported by and suspended from the downturned end portion disposed in immediate communication therewith, an electric motor structurally supported by and suspended from the blower unit with the downturned end portion, the blower unit and the motor being serially arrayed in a vertical line, said blower unit having an integral outwardly tapered outlet laterally extending therefrom and having an open outer end, an elongated flexible exhaust tube having an end attached to and communicating with the open outer end of the outlet, said exhaust tube having a flat side to be adhesively affixed to the face of the rear wall of the bowl with the tube having an outer free end portion located within the trap and having its flat face adhesively secured against the walls of the trap said free end portion having an opening in communication with the water in the pool so that a water seal is provided in the free end portion to prevent sewer gases from gaining access thereto.

2. The invention of claim 1 wherein said flat face of the tube is covered with pressure sensitive adhesive which is overlaid with a removable protective paper which can be stripped away to permit the tube to be pressed into securement with the walls of the bowl and the trap.

* * * * *